United States Patent [19]

Dominguez et al.

[11] Patent Number: 4,951,575

[45] Date of Patent: Aug. 28, 1990

[54] DEPRESSED CENTER BEAM FLAT CAR

[76] Inventors: Danilo A. Dominguez, 1867 Piedras Cir., Danville, Calif. 94526; James F. Flores, 4 Overhill Rd., Mill Valley, Calif. 94941

[21] Appl. No.: 363,875

[22] Filed: Jun. 9, 1989

[51] Int. Cl.[5] ..... B61D 17/00

[52] U.S. Cl. ..... 105/406.1; 105/416; 105/418

[58] Field of Search ..... 410/139; 105/406.1, 105/355, 416, 418

[56] References Cited

U.S. PATENT DOCUMENTS

| | | | |
|---|---|---|---|
| Re. 30,388 | 9/1980 | Mundinger et al. | 410/139 |
| 3,713,400 | 1/1973 | Teoli | 105/406 |
| 3,814,028 | 6/1974 | Adler | 414/679 |
| 3,841,236 | 10/1974 | Hammonds et al. | 105/364 |
| 4,024,821 | 5/1977 | Yang | 105/406 |
| 4,079,676 | 3/1978 | Miller | 105/406 |
| 4,236,459 | 12/1980 | Teoli | 105/406 |
| 4,254,714 | 3/1981 | Heap | 105/406 |
| 4,331,083 | 5/1982 | Landregan et al. | 105/406 |
| 4,361,097 | 11/1982 | Jones et al. | 105/406 |
| 4,408,542 | 10/1983 | Heap | 105/406 |
| 4,543,887 | 10/1985 | Baker | 105/355 |
| 4,681,041 | 7/1987 | Harris et al. | 105/355 |
| 4,753,175 | 6/1988 | Harris et al. | 105/355 |

*Primary Examiner*—Joseph F. Peters, Jr.
*Assistant Examiner*—Virna Lissi Mojica

[57] ABSTRACT

A railway flat car having a depressed load carrying portion to reduce the center of gravity of the car. The flat car includes a side sill assembly having upper end section having floor portions and a lower intermediate section for supporting the depressed load carrying portion. The depressed portion is formed with an overall width less than the upper floor portions. The car is provided with an intermediate longitudinal center sill that merges with end draft sills having a larger width than the center sill.

24 Claims, 5 Drawing Sheets

DEPRESSED CENTER BEAM FLAT CAR

BACKGROUND OF THE INVENTION

1. Field of the Invention

This invention relates in general to railway cars and, more particularly, to a depressed center beam flat car.

2. Description of the Prior Art

At present lumber and other construction material is conventionally transported by railroads in center beam/center partition railcars, generally having a 100 ton nominal capacity built to conform to the Association of American Railroads (AAR) Plate "C" clearance. The distance between end bulkheads of these cars is generally sixty or seventy three feet, and the tare or empty weights range from 63,000 to 69,000 pounds. Cars with tare weight in the foregoing range respectively have lading carrying capacities ranging from 200,000 to 194,000 pounds. The center beam/center partition design permits the construction of lightweight cars with long spans between bulkheads, such as in the previously described car having a length of seventy three feet.

The lumber and the like that is transported in center beam/center partition cars is commonly made up of equal length pieces banded together in modules. The lengths of the modules range from eight to thirty two feet in increments of two foot lengths and nominal four foot widths. The actual width of lumber modules varies according to nominal dimensions of 2"×4", 2"×6", 2"×8", 2"×10", and 2"×12". The height of each module is a constant twenty four inches. The transported lumber is normally air dried having an average density of approximately 31.5 pounds per cubic feet.

The lumber modules can be stacked up to five high on both sides of the center beam/center partition cars. Due to its length between bulkheads, the center beam/center partition car having a seventy-three foot length is preferred over other sizes, because it accomodates a large combination of lengths of lumber and the like. The weight of typical loads of lumber in known center beam/center partition cars in a fully loaded condition is approximately 170,000 pounds. Inasmuch as a standard 100 ton center beam/center partition cars possesses a carrying capacity of 194,000 to 200,000 pounds as stated previously, such existing cars only achieve a payload efficency in the range of 85% to 87.6%.

Center beam/center partition cars of the foregoing design have a center of gravity of approximately ninety-six inches loaded and fifty-six inches empty. The center structure of those cars requires that during loading and unloading, materials must be placed and removed to even weight levels on each side of the center structure to avoid unbalanced loads which can cause the cars to tip-over with the result that lumber modules could be hurled to the ground in various directions like projectiles. Written warnings are clearly stencilled on these existing cars stating that uneven loading and unloading at the sides of the cars can cause tipping of cars sideways. Thus, such standard cars present the potential of damage to the lumber and equipment, and possible safety hazards for personnel during the loading and unloading of materials. Further, the high center of gravity of the loaded car in the prior art produces relativily poor track worthiness and ride stability. Therefore, it is desirable to provide center beam/center partition cars that not only provide greater efficency, but also demonstrate greater stability during loading/unloading and when being transported.

SUMMARY OF THE INVENTION

It is therefore an objective of the present invention to provide an improved center beam flat car of depressed center design demonstrating enhanced operating efficiency and greater stability in use. The depressed center beam flat car of the invention is designed to be comparable in spans between bulkheads and in tare weight to the current designs of such cars. The car herein disclosed employs a depressed load carrying section between the truck assemblies on both sides of the center sill and center beams not contemplated in existing center beam/center partition cars. The depressed floor of the invention is attained by the use of unique means provided at the interface between the depressed feature and the standard floor area near the ends of the car for the adequate tranfer of live and dead loads, and dynamic loads to the longitudinal and transverse structural underframe members. The depressed loading area of the depressed center beam car herein disclosed also significantly increases the available volumetric capacity for loading modules and also substantially lowers the center of gravity of empty and fully loaded cars. The car of the invention is designed within the AAR Plate C clearance diagram.

The depressed center flat car herein disclosed, when, for example, built with a seventy-three foot length between bulkheads, has an additional loading capacity on each side of the center beam of about fifty-six feet in length between the truck assemblies, an additional height of approximately two feet as compared to normal floor level, and an increase of width of four feet from car sides to center beam in comparsion to standard center beam/center partition cars. The depressed section for carrying loads thus results in an additional carrying capacity over known cars of approximately 26,460 pounds for lumber having a density of 31.5 pounds per cubic feet. Thus, the payload carrying efficiency is 196,560/200,00 or 98.3% which achieves an efficiency of over 15% over current center beam/center partition cars. It is also estimated that incorporation of the depressed floor section of the invention will decrease the loaded car center of gravity in the range of ten to fourteen inches. The reduced center of gravity decreases the probability of the car tipping over during the loading/unloading cycles and significantly improves the track worthiness and ride stability of the car.

DESCRIPTION OF A PREFERRED EMBODIMENT

Figure 2:
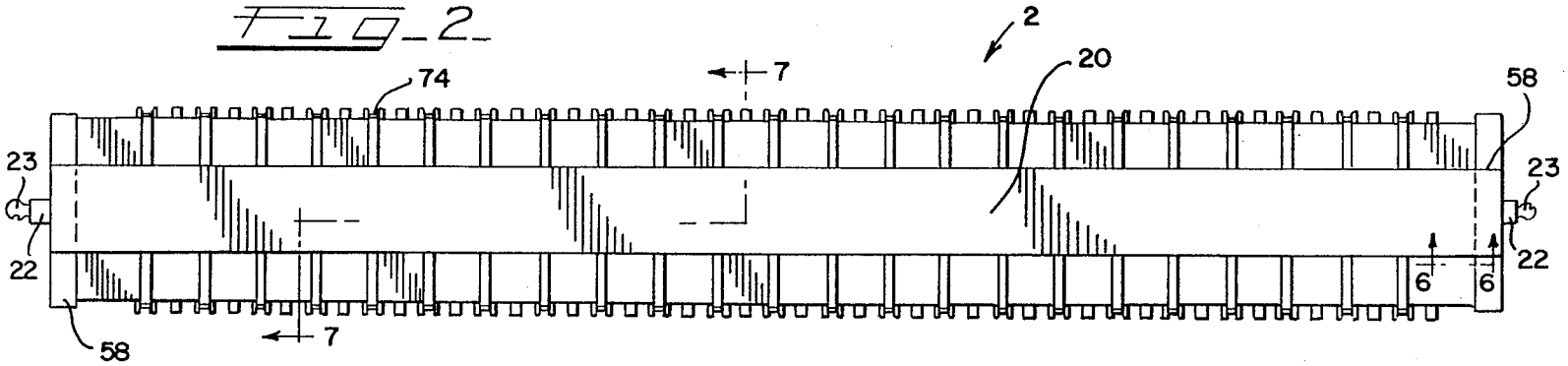
FIG. 2 is a top plan view of the depressed center beam flat car of FIG. 1.
Figure 1:
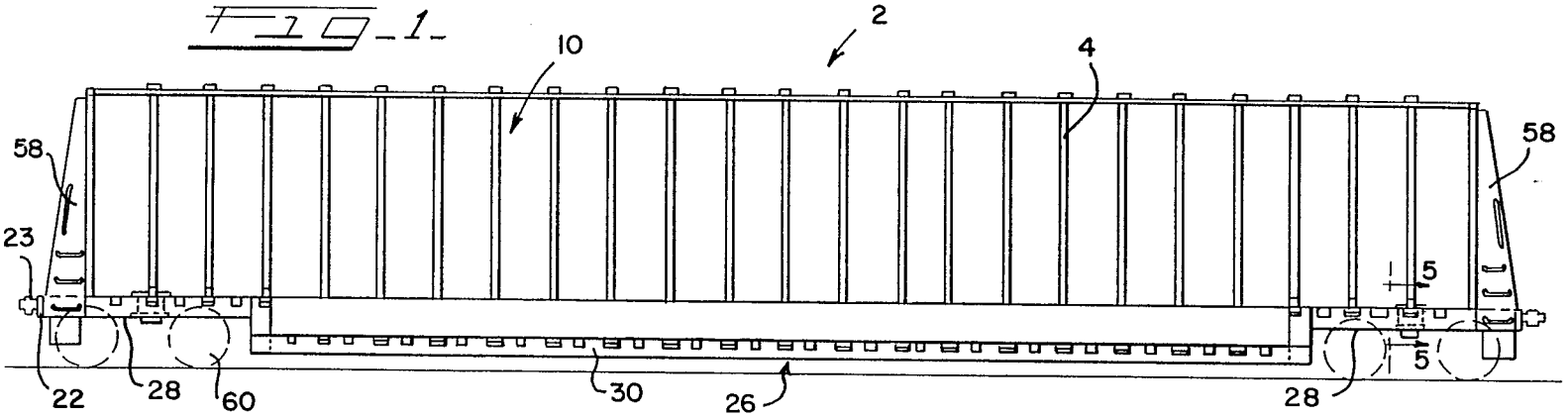
FIG. 1 is a side elevational view, with parts removed, of the depressed center beam flat car of the invention.
Figure 3:
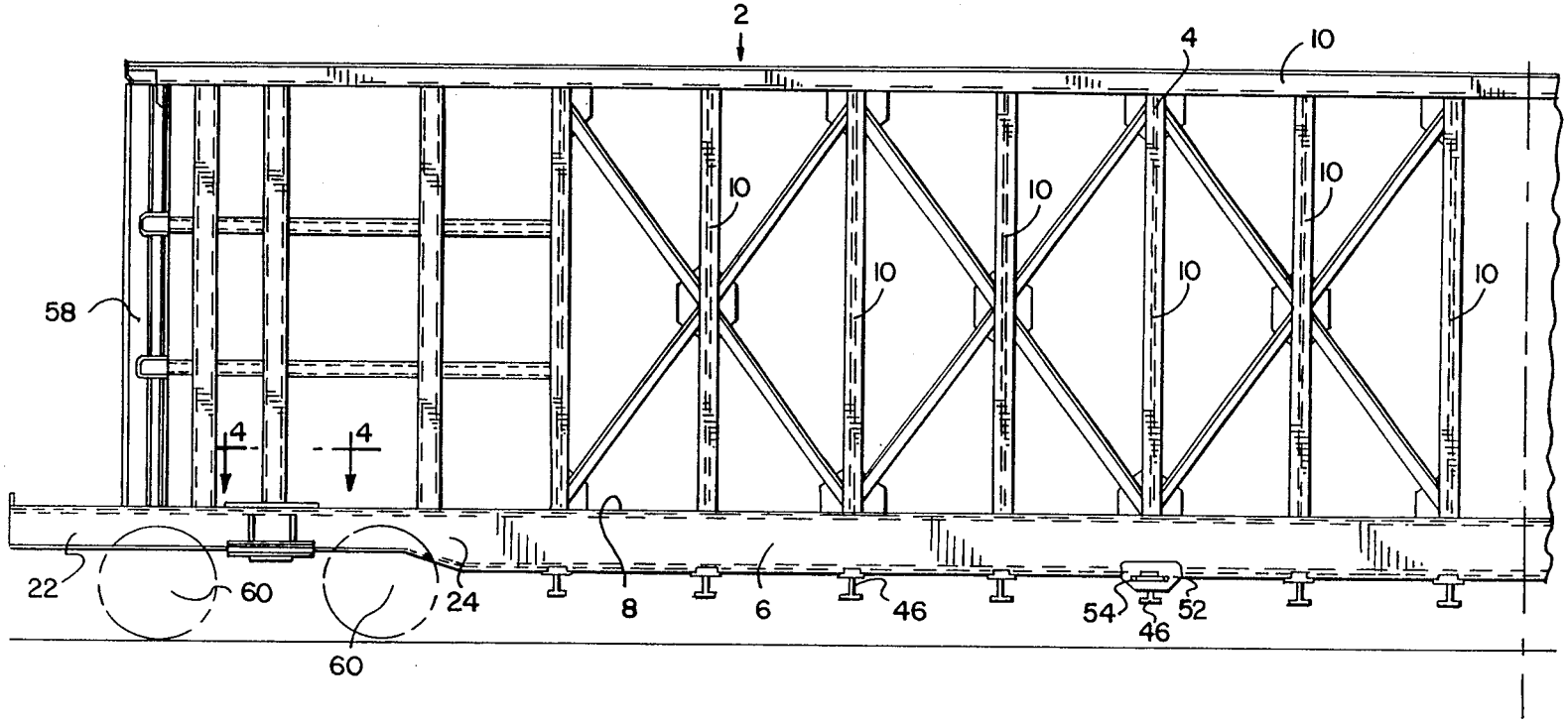
FIG. 3 is a partial side elevational view, with parts removed, of the depressed center beam flat car of FIG. 1 showing among many features the center sill and draft sill.
Figure 4:
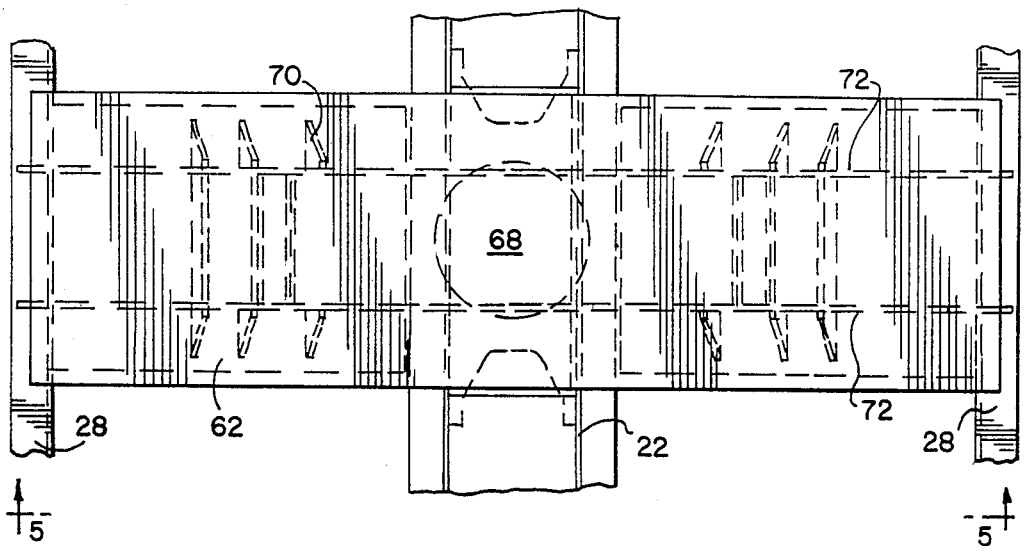
FIG. 4 is a partial plan view taken along lines 4—4 of FIG. 3.
Figure 7:
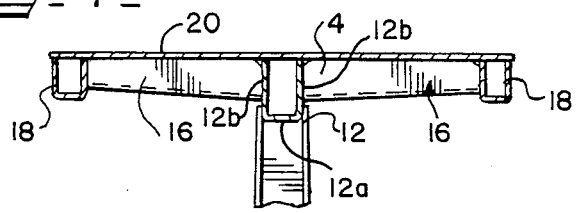
FIG. 7 is an end elevational view, with parts cut away and parts in section, taken along lines 7—7 of FIG. 2.
Figure 7:
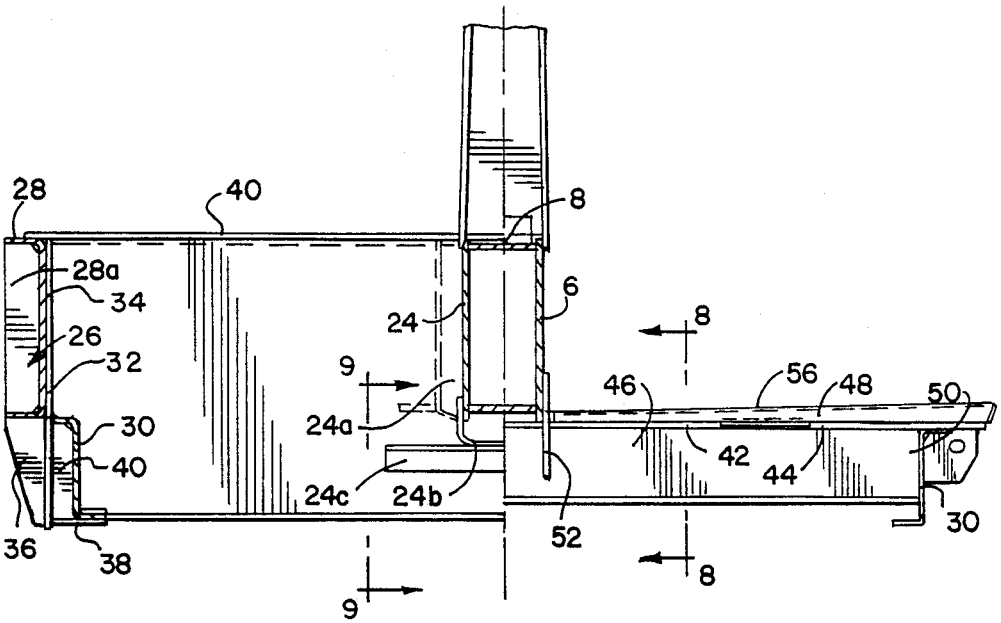

Referring now to FIGS. 1 and 2, there is illustrated the depressed center beam flat car of the invention, generally designated by reference numeral 2. The depressed center beam flat car 2 includes a center beam assembly 4 extending along its longitudinal centerline above a longitudinally extending center sill 6 having an upper surface 8. As best seen in FIG. 7, center sill 6 has a box beam cross section. A plurality of hollow truss vertical column assemblies 10 are spaced along the length of the longitudinal center line of the depressed center beam flat car 2 on upper surface 8 of center sill 6 and the pair of draft sills to be described. In FIG. 7 a longitudinally oriented upper center beam assembly 4 is carried by the top ends of the truss vertical column assemblies 10, as illustrated in FIG. 7. The upper beam assembly 4 includes a horizontal extending continuous center beam 12, having a U-shaped cross-section, which includes a lower portion formed by a lower horizontal section 12*a* and a portion of spaced vertical sections 12*b*. The lower section 12*a* and a lower portion of vertical sections 12*b* are affixed within the upper end of each of the truss vertical column assemblies 10. A pair of opposed center beam cross ties 16 are welded to center beam 12 at each of the top ends of the truss vertical column assemblies 10 and respectively project outwardly to support a center beam side sill 18 on each side of the center beam assembly 4 (FIG. 3). A center beam cover plate 20 is attached to the center beam 12, side sills 18, and plurality of cross ties 16 to form an continuous upper surface over the upper center beam assembly 4.

Figure 10:
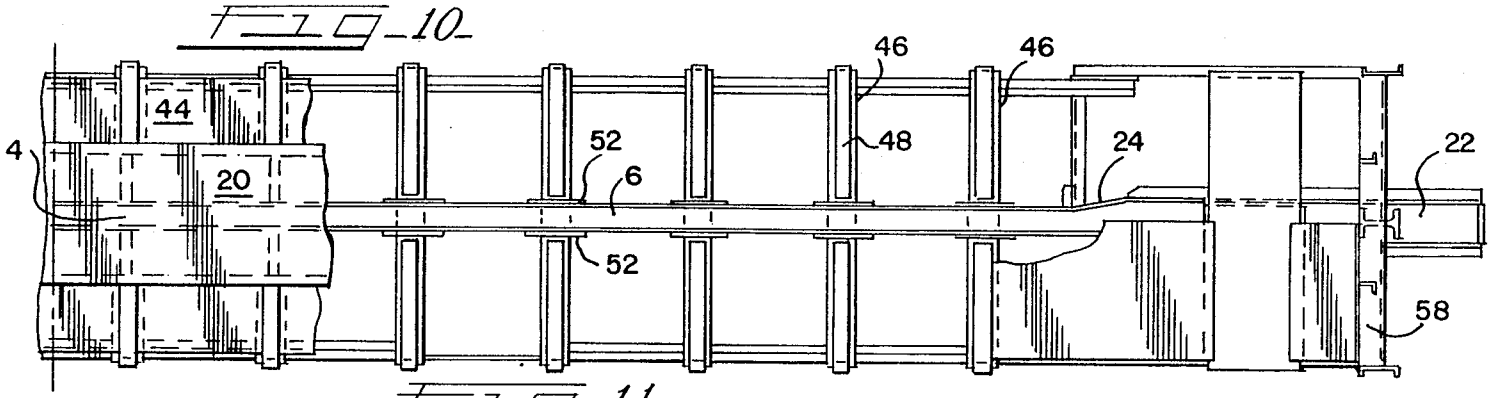
FIG. 10 is a partial plan view, with parts removed, of the depressed center beam flat car of FIG. 1.
Figure 11:
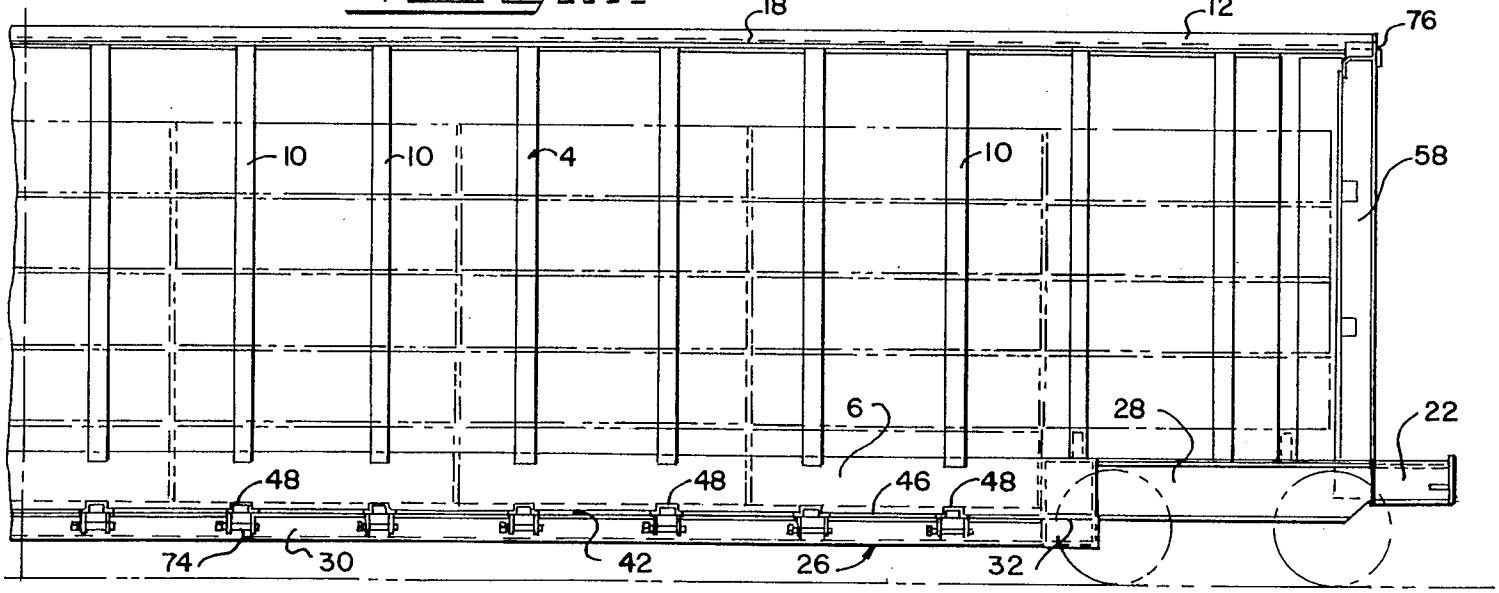
FIG. 11 is a partial side elevational view, with parts removed, of the depressed center beam flat car of FIG. 1.

A pair of draft sills 22 are suitably supported on opposite ends of the center beam flat car 2, and each carry a conventional coupler 23 at their outboard ends as seen in FIGS. 1, 2, and 11 and some of the truss column assemblies 10 on their upper surface. The draft sills 22 merge with the longitudinally extending center sill 6 at a center sill transition section 24 as best seen in FIGS. 3, 7, and 10. The center sill transition section 24 includes a slanted center sill transition member 24*a*. A web plate transition tie 24*b* having a upward opening U-shaped configuration is affixed to the bottom portion of center sill 6. A center sill/web plate transition tie support 24*c* in the form of an angle member carries the web plate tie 24*b*, and is attached to a web plate 24*d* that extends outward to the side sills to be described. As seen in FIG. 10, the horizontal width of center sill 6 is reduced as compared to the draft sills 22 at each end for reasons to be described.

Referring to FIGS. 7, 10, and 11, a pair of side sill assemblies 26 extend the length of the depressed center beam flat car 2 on both sides. The side sill assemblies 26 include an upper side sill section 28 at each end and a depressed intermediate side sill section 30 as illustrated in FIGS. 1, 7 and 11. As seen in FIG. 7, the end side sill sections 28 are formed in a modified U-shaped cross-sectional configuration opening outward and are reinforced by side sill stiffeners 28*a*. The depressed side sill intermediate section 30 is formed with a modified cross-sectional Z-shape as shown in FIG. 7. As best seen in FIG. 7, the depressed side sill section 30 is unified with the adjacent upper side sill sections 28 at each end by a side sill transition assembly 32. The side sill transition assembly 32 comprises a welded vertical side sill tie plate 34 having an affixed triangular shaped transition tie plate gusset 36 disposed under the upper side sill sections 28. A transition bottom tie plate 38 is affixed to the bottom of the depressed side sill section 30 and is further attached at its outer edge to the side sill tie plate 34. A lateral vertical lower transition tie plate 40 is disposed above the transition tie plate 38 in welded relationship to depressed side sill section 30 and side sill transition tie plate 34. The side sill transition assembly 32 maintains the structural integrity between upper side sill end sections 28 and the depressed side sill sections 30. From the foregoing, it should be apparent that end sections 28 of each side sill assembly 26 are oriented along an axis vertically above the longitudinal axis of intermediate side sill section 30. The longitudinal axis of the intermediate side sill section 30 is also laterally spaced inward toward center sill 6 by a distance less than the axis of end side sill sections 28.

The end portions of the depressed center beam flat car 2 above the upper side sill sections 28 include symetrically oriented upper floor sheets 40 carried by the end side sill sections 28 and the draft sills 22, as shown in FIGS. 7 and 11. A floor section 42 is positioned above the intermediate side sill sections 30 and are in a depressed planar orientation below floor sheets 40 by a suitable distance, such as, for example, by approximately fourteen to eighteen inches. The longitudinal extent of the depressed sections 42 may be approximately 75% of the between bulkhead length of depressed center beam flat car 2. As seen in FIGS. 7,8,10 and 11, the depressed floor section 42 comprises a plurality of floor sheets 44 supported by a plurality of spaced cross bearer assemblies 46. The floor sheets carry a plurality of upper tapered pieces 48 on which the commodity to be transported may be arranged. The cross bearer assemblies 46 in the form of I-beams and are arranged in spaced relationship to each other between the side assemblies 26 with their outer end portions 50 being affixed respectively to the opposed intermediate side sill sections 30. (FIG. 7).

Figure 8:
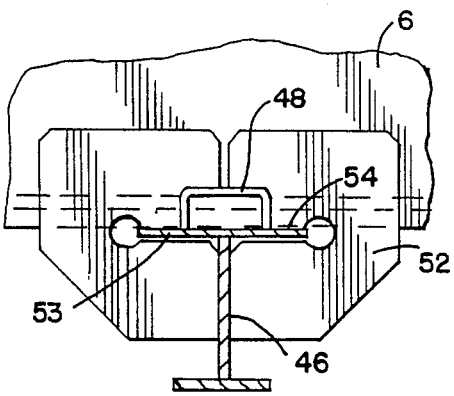
FIG. 8 is a partial side elevational view, with parts in section, taken along lines 8—8 of FIG. 7.
Figure 9:
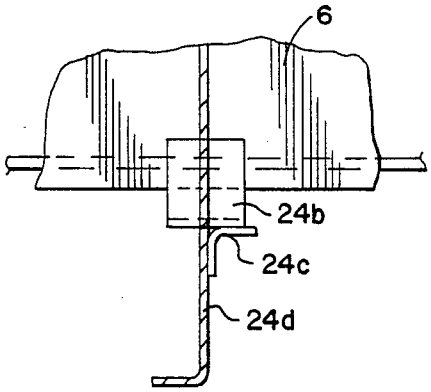
FIG. 9 is partial side elevational view, with parts in section, taken along lines 9—9 of FIG. 7.

As shown in FIG. 8, the intermediate portions of the cross bearing assemblies 46 are respectively supported by a laterally aligned pair of cross bearer supports 52 in the form of plates, through which the upper flanges 53 of cross bearing assemblies 46 extend in suitable slots 54. The pairs of cross bearer supports 52 are suitably attached on opposite sides of center sill 6 and project downward. The upper surface 56 of the tapered pieces 48 are tapered downward from the side sill assemblies 26 toward the center of the depressed center beam flat car 2. As is well known, the tapered top surfaces 56 orient the carried load toward the center of the depressed center beam flat car 2 for better stability. Further, the depressed floor section 42 lowers the center of gravity of the depressed center beam flat car 2 for a significant increase in stability. As seen in FIG. 10, the depressed floor section 42 has a reduced overall width as compared to the width of upper floor sheets 40 at each end. Such reduced floor width allows commodities of standard width, i.e. 48 inches, to be carried on the depressed floor section 42 and comply with existing regulations mandating clearance. The reduced width of depressed section 42 is provided by the reduced horizontal width of center sill 6 as compared to draft sills 22. The union of the center sill 6 and draft sills 22 is effected by means of the center sill transition section 24. Further, the inward orientation of intermediate side sill section 30 relative to end side sill sections 28 provides outward support of the reduced width of depressed floor section 42.

Figure 5:
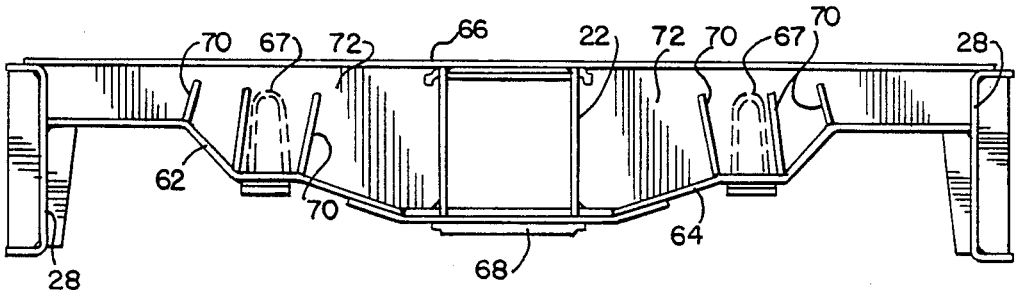
FIG. 5 is a partial end elevational view taken along lines 5—5 of FIG. 1.
Figure 6:
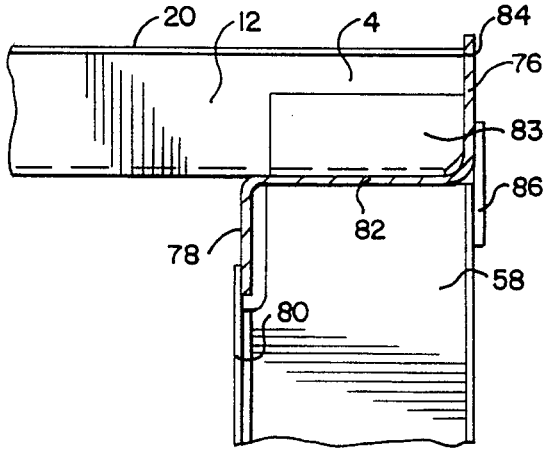
FIG. 6 is a partial end elevational view, with parts in section, taken along lines 6—6 of FIG. 2.

A bulkhead assembly 58 of conventional design is mounted on each end of the depressed center beam flat car 2 at a position above draft sill assembly 22. The depressed center beam flat car 2 is carried by a pair of conventional truck assemblies (not shown) having wheels 60 (FIG. 3). Although trucks of any suitable capacity can be used in the invention, the truck assemblies may be, for example, of a 100 ton design. A bolster assembly 62 is mounted at each end of depressed center beam flat car 2 above the truck assemblies. As seen in FIGS. 5 and 6, the body bolster assembly 62 includes a bottom cover plate 64, which is welded to side sill sections 28, the draft sill assembly 22, and a body bolster cover plate 66. A body side bearing 68 is arranged below bottom cover plate 64 and reinforced by body bearing reinforcement 67. The body bolster assembly 62 is further reinforced by three body bolster web stiffeners 70 and bolster webs 72. A plurality of winch assemblies 74 are carried on the side sill assembly 26 at plurality of locations to secure cables for retaining the load in a known manner.

As seen in FIG. 6, the outboard ends of the upper center sill assembly 12 is affixed to the upper portions of each bulkhead assembly 58 by means of a modified Z-shaped plate 76. A lower vertical section 78 of plate 76 is affixed to the inboard panel 80 of bulkhead assembly 58. The intermediate horizontal section 82 of plate 76 forms a lower support for the ends of upper center sill 12, which are open at end portion 83. The upper vertical section 84 of plate 76 also retains the ends of center sill 12. A stiffener plate 86 is welded to the outboard wall of bulkhead assembly 58 and the upper section 84 of the plate 76. Both ends of the upper side sills 18 are retained on the bulkhead assemblies by a plate (not shown) of similar configuration as plate 76, but having smaller dimensions to conform to the reduced size of side beams 18.

What is claimed is:

1. A flat car supported on end truck assemblies comprising a body formed by a longitudinally extending center sill, a draft sill attached to each end of said center sill, and a pair of bulkheads mounted at each end, side sill means disposed on opposite sides of said center sill on said body, a vertical center beam assembly extending upward from said center sill, said vertical center beam assembly including an upper center sill extending parallel above said center sill between said bulkheads, said upper center sill being supported by a plurality of columns carried by at least said center sill, and floor means being arranged between said opposite side sill means, said floor means having end floor sections lying in a first generally horizontal plane and an intermediate depressed floor section disposed in a second generally horizontal plane lying below said first horizontal plane, said side sill means includes a pair of side sill assemblies disposed on opposite sides of said center sill, each of said side sill assemblies includes a pair of upper end sections extending along an upper axis for respectively supporting said end floor sections and an intermediate section extending along a lower axis disposed below said first axis for supporting said intermediate depressed floor section.

2. A flat car supported on end truck assemblies comprising a body formed by a longitudinally extending center sill, a draft sill attached to each end of said center sill, and a pair of bulkheads mounted at each end, side sill means disposed on opposite sides of said center sill on said body, a vertical center beam assembly extending upward from said center sill, said vertical enter beam assembly including an upper center sill extending parallel above said center sill between said bulkheads, said upper center sill being supported by a plurality of columns carried by at least said center sill, and floor means being arranged between said opposite side sill means, said floor means having end floor sections lying in a first generally horizontal plane and an intermediate depressed floor section disposed in a second generally horizontal plane lying below said first horizontal plane, a plurality of cross bearer members extending between said side sill means on said opposite sides of said center beam, said cross bearer members acting to support said intermediate depressed floor section, and said plurality of cross bearer members are supported beneath said center sill.

3. The flat car according to claim 1 wherein said lower axis extends parallel to said center sill, said end sections of said side sill assemblies respectively being disposed along said upper axis in parallel relationship to said lower axis.

4. The flat car according to claim 3 wherein said lower axis of said intermediate section is spaced inward toward said center sill from said upper axis of said end sections.

5. The flat car according to claim 1 wherein said side sill means includes side sill transition means for joining said end sections of each of said side sill assemblies to said intermediate section.

6. The flat car according to claim 5 wherein said side sill transition means for each of said side sill assemblies includes a pair of vertical members affixed to respective end portions of said end sections and of said intermediate section.

7. The flat car according to claim 6 wherein said pair of vertical members comprise a pair of vertical plates having a surface affixed to said end sill sections and a surface affixed to said intermediate section.

8. The flat car according to claim 1 further comprising a plurality of cross bearer members extending between said side sill means on said opposite sides of said center beam, said cross bearer members acting to support said intermediate depressed floor section.

9. The flat car according to claim 8 wherein said plurality of cross bearer members are supported beneath said center sill.

10. The flat car according to claim 2 further comprising cross supports carried by said center sill, each of said cross bearer members being respectively supported by at least one of said cross bearer supports.

11. The flat car according to claim 10 wherein each of said plurality of cross bearer supports include a lower portion extending downward from said center sill, each of said cross bearer members is respectively supported on at least one of said lower portions.

12. The flat car according to claim 11 wherein each of said plurality of cross bearer members extend through at least one of said lower portions.

13. The flat car according to claim 11 wherein said plurality of cross bearer supports include a vertical plate forming said lower portion.

14. The flat car according to claim 13 wherein said plurality of cross bearer supports comprise laterally aligned pairs of vertical plates, each of said plurality of cross bearer support members being respectively supported by an aligned pair of said vertical plates.

15. A flat car supported on truck assemblies and having vertical column assemblies comprising a body formed by a longitudinally extending center sill, a draft sill mounted at each end of said enter sill, and a pair of bulkheads disposed above said draft sills, a pair of upper floor sections being respectively carried on said body adjacent said bulkheads and having upper surfaces lying in a first plane, an intermediate floor section carried by said body and extending between said pair of upper floor sections, said intermediate floor section forming an upper surface lying in a plane disposed below said first plane, said upper floor sections are symmetrically arranged above each of said draft sills, said intermediate floor section is symmetrically arranged adjacent said center sill, and said center sill has a narrower horizontal width than said draft sill, said upper surfaces of said upper sections having a horizontal width greater than said upper surface of said intermediate section.

16. The flat car according to claim 15 wherein the width of the upper surface of said intermediate floor is less than the width of said upper surfaces of said pair of upper floor sections.

17. The flat car according to claim 15 further comprising center sill transition means for connecting each of said draft sills to said center sill having a narrower width.

18. A flat railroad car comprising a body supported at each end by truck means, said body having a longitudinal center sill, a draft sill mounted at each end of said center sill, and a pair of bulkheads mounted at each end of said body, center beam means connected to said center sill and having a plurality of spaced vertical truss columns, an upper horizontal beam being retained on the upper ends of said truss columns and extending between said bulkheads, said upper horizontal beam having a lower horizontally arranged section and a pair of vertical spaced sections extending upward from said horizontally arranged section, a plurality of lateral cross ties projecting from the outer surfaces of said vertical spaced sections, a pair of side sills being attached to the ends of said cross ties and being carried by said bulkheads, and a continuous cover plate being affixed to the top of said side sills, said cross ties, and said upper horizontal beam, said horizontally arranged section and a lower portion of said vertical spaced sections are disposed within the top portion of said vertical truss columns, said lower portion of said vertical spaced sections being joined to said vertical truss columns.

19. The flat railroad car of claim 18 wherein the end portions of said upper center beam are respectively affixed to said bulkheads, plate means affixed to said end portions and said bulkheads for affixing said upper center beam to each of said bulkheads.

20. A flat car supported on truck assemblies and having vertical column assemblies comprising a body formed by a longitudinally extending center sill, a draft sill mounted at each end of said center sill, and a pair of bulkheads disposed above said draft sills, a pair of upper floor sections being respectively carried on said body adjacent said bulkheads and having upper surfaces lying in a first plane, an intermediate floor section carried by said body and extending between said pair of upper floor sections, said intermediate floor section forming an upper surface lying in a plane disposed below said first plane, said upper floor sections are symmetrically arranged above each of said draft sills, said intermediate floor section is symmetrically arranged adjacent said center sill, and said intermediate floor section is disposed below said center sill.

21. The flat car according to claim 20 further comprising a plurality of cross members carried by said center sill, a pair of side sill assemblies attached to said cross members on opposite sides of said center sill.

22. The flat car according to claim 20 wherein said intermediate floor section is carried by said cross members.

23. The flat car according to claim 1 wherein said upper end sections have a U-shaped cross sectional configuration.

24. The flat car according to claim 23 wherein said intermediate section has a modified Z-shaped cross sectional configuration.

* * * * *